United States Patent [19]

Coyle

[11] 4,176,836

[45] Dec. 4, 1979

[54] VARIABLE RESISTANCE EXERCISING APPARATUS AND METHOD

[76] Inventor: Randy Coyle, 19 High St., Glen Ridge, N.J. 07028

[21] Appl. No.: 808,638

[22] Filed: Jun. 21, 1977

[51] Int. Cl.[2] ..... A63B 21/00

[52] U.S. Cl. ..... 272/120

[58] Field of Search ..... 104/62; 272/72, 18, 272/116-120, 126, 137, 127, 134, 144, 145; 273/191 A, 55 R

[56] References Cited

U.S. PATENT DOCUMENTS

| | | | |
|---|---|---|---|
| 339,638 | 4/1886 | Goldie | 272/120 |
| 682,988 | 9/1901 | Hazelip | 272/120 |
| 684,688 | 10/1901 | Herz | 272/117 |
| 1,996,350 | 4/1935 | Schaff | 272/120 |
| 2,183,345 | 12/1939 | Brandon | 272/72 |
| 2,455,548 | 12/1948 | Bell | 272/120 |
| 2,642,288 | 6/1953 | Bell | 272/120 |
| 2,783,045 | 2/1957 | Bosch | 272/120 |
| 3,394,934 | 7/1968 | Elia et al. | 272/120 X |
| 3,794,329 | 2/1974 | Wilson | 273/191 A |
| 3,858,873 | 1/1975 | Jones | 272/117 |

FOREIGN PATENT DOCUMENTS

| | | | |
|---|---|---|---|
| 355952 | 7/1922 | Fed. Rep. of Germany | 272/72 |
| 2318456 | 10/1974 | Fed. Rep. of Germany | 272/72 |
| 850610 | 9/1939 | France | 272/120 |

*Primary Examiner*—Richard J. Apley
*Attorney, Agent, or Firm*—Anthony F. Cuoco

[57] ABSTRACT

Exercising apparatus and method whereby the resistance encountered by the body part or parts being exercised is varied by moving the body part or parts along a discretely curved incline, whereby the resistance varies automatically and instantaneously commensurate with the sine of the angle of the incline.

4 Claims, 5 Drawing Figures

| DISTANCE OF CARRIAGE FROM START | CARRIAGE ANGLE | % INCREASE IN RESISTANCE FROM START |
|---|---|---|
| 0 | 28° | 0 |
| 6" | 30° | 1.066 |
| 12" | 33° | 1.058 |
| 18" | 37° | 1.162 |
| 24" | 41° | 1.066 |
| 30" | 44° | 1.057 |

VARIABLE RESISTANCE EXERCISING APPARATUS AND METHOD

BACKGROUND OF THE INVENTION

1. Field of the Invention

This invention relates generally to exercising apparatus and method. More particularly, this invention relates to exercising apparatus and method whereby the resistance encountered by the exerciser varies automatically and instantaneously.

2. Description of the Prior Art

The advantages of incorporating variable resistance into exercising apparatus have been well established. These advantages include providing a resistance that corresponds closely to the strength curve of the body part or parts being exercised. Also, the chances of injury to the exerciser are minimized when it is considered that the variable resistance can accommodate the particular weakness of the body part as is the case, for example, at the beginning of the exercise. Finally, the variable resistance enables the exerciser to encounter a higher level of exercise intensity, if desired.

The variable resistance concept is recognized in U.S. Pat. No. 3,858,873 issued on Jan. 7, 1975 to Arthur A. Jones. However, the present invention affords the exerciser the aforenoted variable resistance features in a simplier and thereby more effective way than has been accomplished by this and other prior art.

SUMMARY OF THE INVENTION

This invention contemplates variable resistance exercising apparatus and method whereby a discretely curved incline is provided and the exercise is accomplished by exerting a force to move the exerciser's body part or parts being exercised up the incline so that the resistance encountered corresponds closely to the strength curve of the body part or parts being exercised, and which resistance varies automatically and instantaneously with the sine of the angle of the incline.

One object of this invention is to provide variable resistance exercising apparatus and method.

Another object of this invention is to provide the variable resistance by moving the exerciser's body part or parts being exercised up a discretely curved incline, wherein the resistance encountered by the body part or parts varies instantaneously and automatically with the sine of the angle of the incline.

Another object of this invention is to provide variable resistance exercising apparatus and method which varies the resistance commensurate with the strength curve of the body part or parts being exercised to lessen the chances of injury to the exerciser and to provide the level of exercise intensity that is desired.

The foregoing and other objects and advantages of the invention will appear more fully hereinafter from a consideration of the detailed description that follows taken together with the accompanying drawings wherein a single embodiment of the invention is illustrated. It is to be expressly understood, however, that the drawings are for illustration purposes only and are not to be construed as defining the limits of the invention, reference being had to the appended claims for that purpose.

DESCRIPTION OF THE INVENTION

Figure 1:
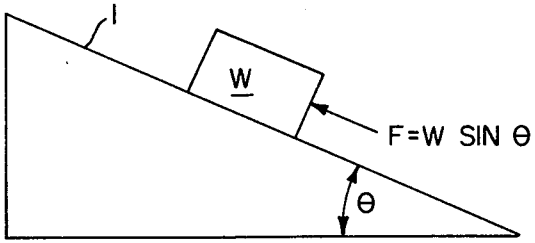
FIG. 1 is a diagrammatic representation illustrating a trigonometric relationship involved in the invention.

With reference first to FIG. 1, it is a well known principle that an inclined plane may be used to reduce the force required to raise a weight W, as compared to the force required to vertically raise the weight. Thus, to move weight W up an inclined plane 1 at an angle $\theta$ with the horizontal, a force F is required which varies directly with the sine of angle $\theta$ as follows:

$$F = W \sin \theta$$

If angle $\theta$ is 30°, the force F required to move weight W a unit distance up inclined plane 1 equals 0.500 W, since the sine of 30° is 0.500. Likewise, if angle $\theta$ is 45° force F required to move weight W a unit distance up inclined plan 1 equals 0.707 W and if angle $\theta$ is 60° force F equals 0.866 W.

It will be seen that the steeper the angle of the incline the greater the force required to move the weight a unit distance up the incline. That is to say, the steeper the angle of the incline, the greater the resistance that the weight offers to movement. Thus, when angle $\theta$ is at 45° force F required to move weight W up incline 1 is the quotient of the sine of 45° divided by the sine of 30° (0.707/0.500), or 1.414 times the force required for a 30° incline. Likewise, when angle $\theta$ is 60°, the force required is the quotient of the sine of 60° divided by the sine of 45° (0.866/0.707) or 1.255 times the force required for a 60° incline. This relationship is used to provide a variable resistance exercising device as will be next described with reference to FIGS. 2, 3, 4 and 5.

Figure 3:
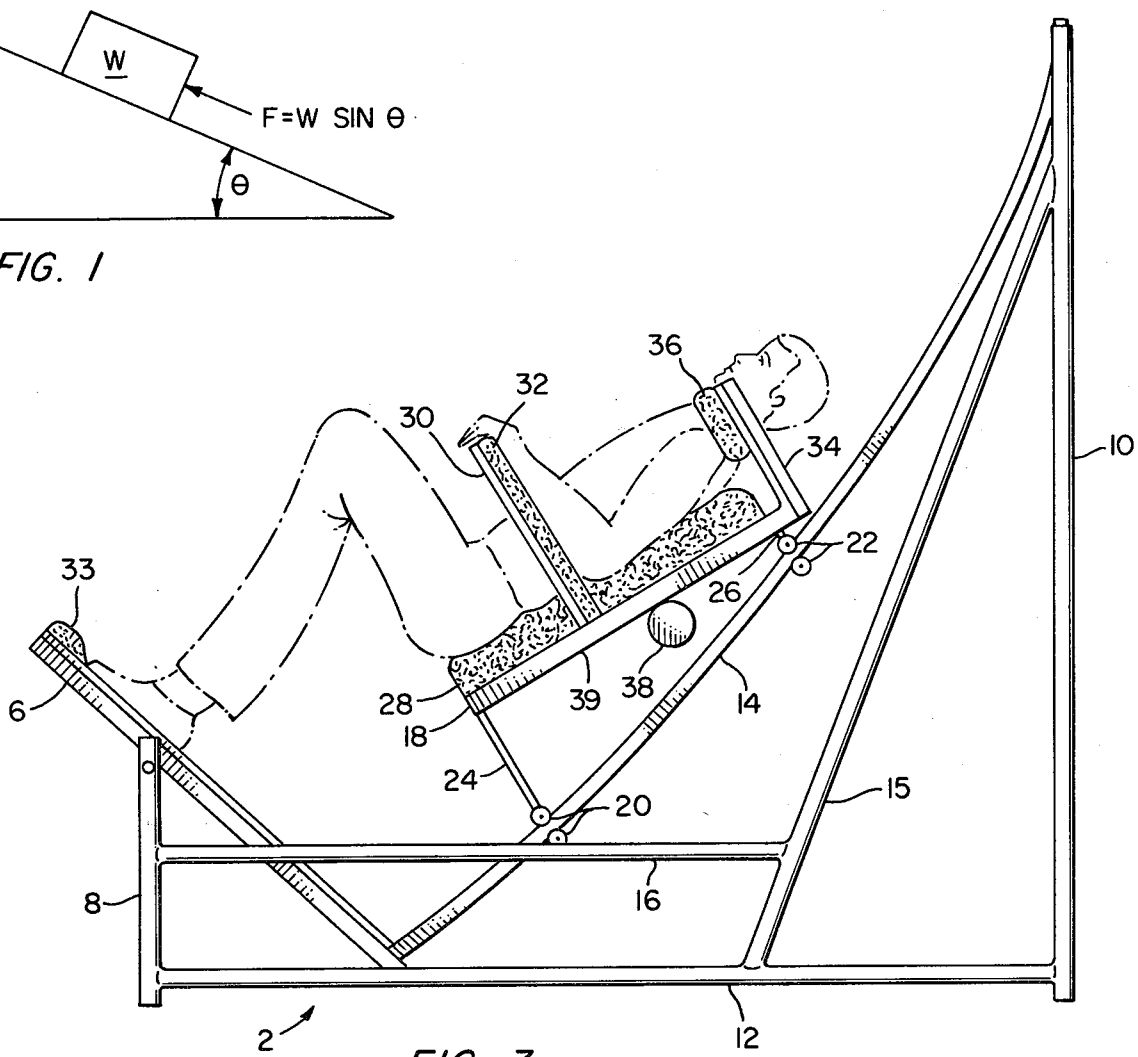
FIG. 3 is a side elevation view of the apparatus of the invention, with an exerciser outlined in phanthom on the apparatus and in a position in which particular body parts are being exercised.
Figure 2:
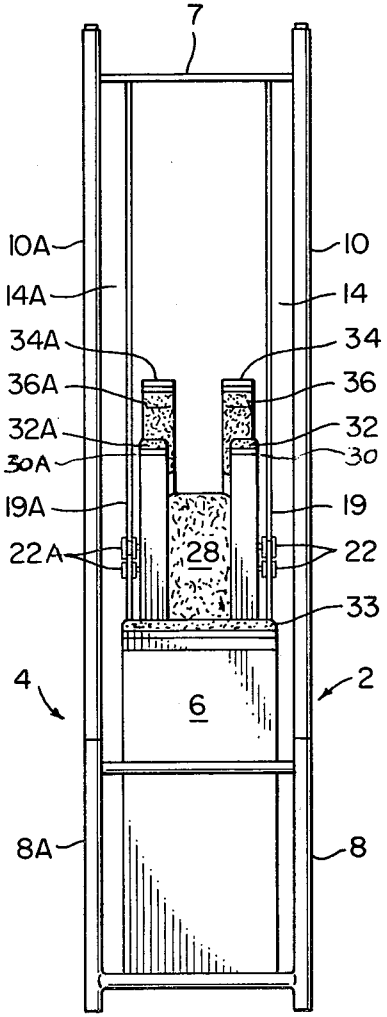
FIG. 2 is a front elevation view of the apparatus of the invention.

With reference to FIGS. 2 and 3, there is shown, for purposes of illustrating the invention, exercising apparatus that provides a variable resistance when performing what is commonly known as a deep-knee-bend exercise. By way of introduction, the deep-knee-bend exercise is performed by the exerciser with his feet braced, exercising his thigh and hip muscles and to thereby perform a compound exercise. At the start of the deep-knee-bend exercise the legs are bent and the knees are drawn close to the chest of the exerciser (such as in a fetal position), and as the exercise progresses the knees are displaced away from the chest until the exercise is completed, whereupon the legs are in an extended position.

FIGS. 2 and 3 show exercising apparatus for performing the deep-knee-bend exercise as heretofore described, and which apparatus includes a pair of side frames 2 and 4 which are identical and substantially parallel and in spaced relation to each other. Side frames 2 and 4 are supported in said spaced relation by a transversely extending foot rest member 6 and a transversely extending upper cross-bar member 7.

The invention is best illustrated by describing the side frames, and for this purpose specific reference is now made to FIG. 3 which shows the elements of side frame 2 in substantial detail. Corresponding elements of side frame 4 as shown in FIG. 2 have corresponding numerical designations, but carrying the subscript "A".

Thus, side frame 2 includes a short vertical member 8 and a substantially longer vertical member 10, and which vertical members 8 and 10 are separated by a horizontal member 12. Foot rest member 6 extends angularly upward from horizontal member 12 and has secured near the bottom thereof a discretely curved rail 14 which extends upward to cross-bar member 7 to form an inclined plane with an instantaneously varying angle of incline.

A supporting member 15 extends angularly and downward from vertical member 10 to horizontal member 12 and is secured to said members 10 and 12, while another supporting member 16 extends horizontally from vertical member 8 to angularly extending supporting member 15, and is likewise secured to said members 8 and 15.

It is to be noted that this is but one structural arrangement for side frames 2 and 4, with other structural arrangements being within the scope and accomplishing the purposes of the invention. Further, the frame members, which may be metallic tubular or pipe like members, may be secured to each other as by welding or the like. The important feature of the invention, as will become evident, is discretely curved rail 14 of side frame 2 and corresponding rail 14A of side frame 4, and which feature will be hereinafter described.

A carriage 18 is supported on tracks 19 and 19A, respectively, on curved rails 14 and 14A by front rollers 20 and rear rollers 22 so as to be movable along the rails. In this connection it is noted that front rollers 20 are carried by front legs 24 extending downward from the front of the carriage to the rails and rear rollers 22 are carried by substantially shorter rear legs 26 extending downward from the rear of the carriage so that the rear of the carriage is near the rails.

Carriage 18 carries a padding or the like 28 for supporting the back of the exerciser. The padding may be of upholstered foam rubber or other such similar material as is common in exercising apparatus of the type being described. Extending outwardly from and substantially normal to carriage 18 are arm rests 30 and 30A for supporting the arms of the exerciser. Arm rests 30 and 30A may likewise carry foam rubber pads 32 or the like such as described with reference to pad 28 carried by carriage 18, while foot rest 6 may carry a foam rubber foot stop 33 at the end thereof.

Extending substantially normal to and outwardly from the top of carriage 16 are shoulder restraints 34 and 34A. The shoulder restraints may carry foam-rubber pads 36 such as described with reference to carriage pad 28, arm-rest pads 32 and foot stop 33. The aforenoted pads provide convenient supporting and/or restraining means for the respective members of the exerciser's body and serve the further purpose of preventing injury to the exerciser while the exercise is being performed as might otherwise be the case.

Arm rests 32 and 32A and should restraints 34 and 34A may be adjustable relative to carriage 18 to accommodate various body proportions of the exerciser as will now be understood by those skilled in the art.

The purpose of the exercise being described is to exercise the thigh and hip muscles of the exerciser. This is accomplished by the exerciser pushing against foot rest 6, whereby carriage 16 is displaced upwardly along discretely curved rails 14 and 14A. As is well known in the exercising field, the muscle or muscle group being exercised has a particular strength curve that is substantially the same irrespective of the body proportions or the strength of the exerciser. However, the amount of weight that an exerciser can or should move does vary with his body proportions and strength and with his other physical characteristics, and for this purpose a weight 38, which may be of the simple bar-bell type, is secured to the under side 39 of carriage 18, and which weight may be varied depending upon the aforenoted physical characteristics of the exerciser, his strength and the degree of exercise intensity desired.

The variable-resistance feature of the exercising apparatus and method of the invention is best illustrated with reference to FIGS. 4 and 5.

Figures 4, 5:
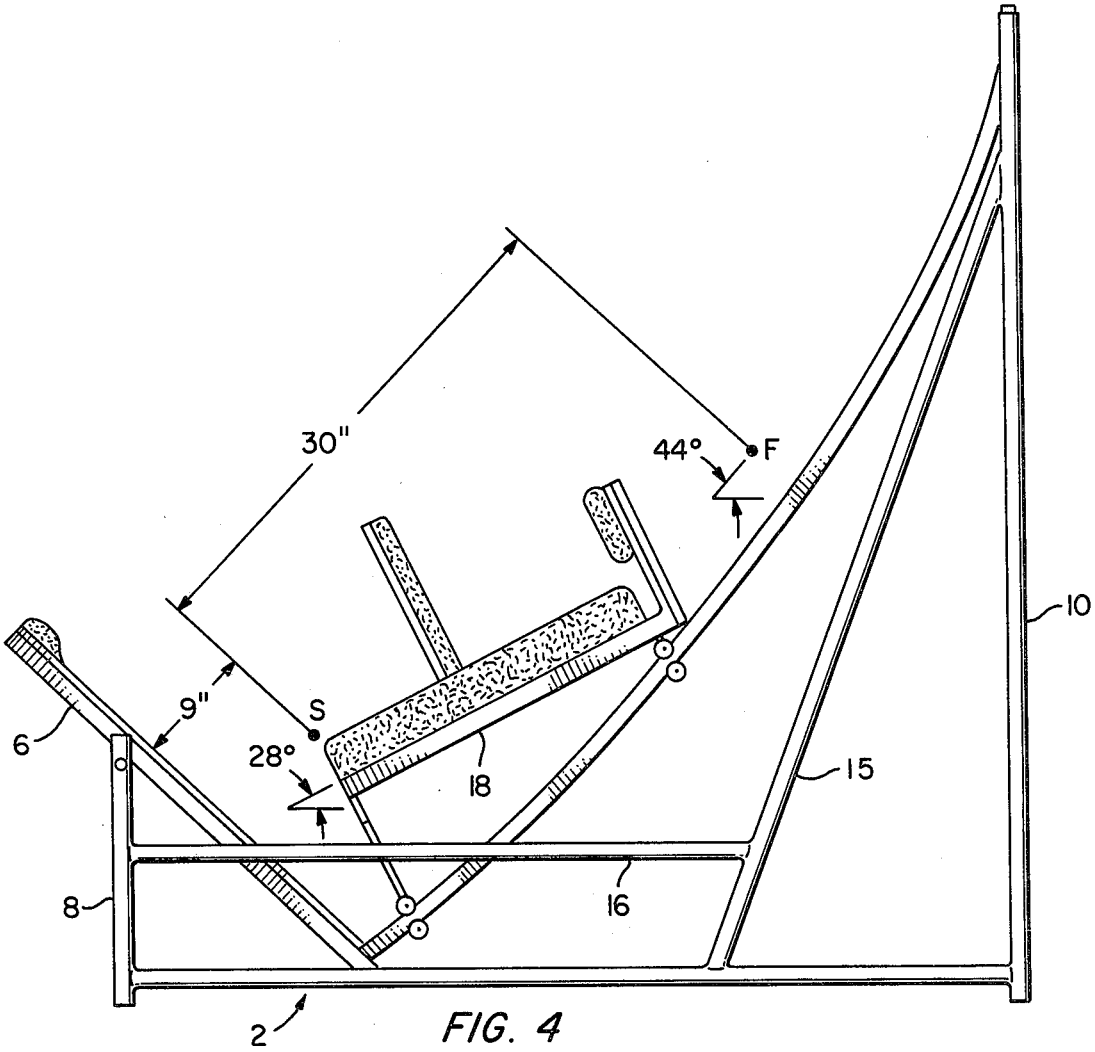
FIG. 4 is a side elevation view of the apparatus of the invention and illustrating the application of the relationship shown in FIG. 1.
FIG. 5 is a chart explanatory of the diagrammatic representation of FIG. 4.

With reference to FIG. 4, carriage 18 is arranged to move along rails 14 and 14A upon the exerciser exerting a force against foot rest 6 as heretofore described with reference to FIGS. 1 and 2. The arrangement is such that, for purposes of illustration, at the start of the deep-knee-bend exercise being described, the front of carriage 18 is disposed along rails 14 and 14A approximately nine inches from foot rest 6 as shown in FIG. 4. At this starting point, designated as S in the Figure, the angle between the carriage and the horizontal is approximately 28°. As the carriage is displaced by the exerciser further from the foot rest along curved rails 14 and 14A, the angle the carriage makes with the horizontal varies as shown in the chart of FIG. 5. Thus, when the carriage front is displaced six inches from starting point S, the angle is approximately 30° and when the carriage displacement is twelve inches the angle is approximately 33°. The carriage angle automatically and instantaneously varies in accordance with the curve of rails 14 and 14A, which is based on the strength of the muscle group or groups being exercised, until the carriage front reaches the end of its displacement at a point F shown in FIG. 4, and which point F the carriage angle is approximately 44°.

As will be seen from FIG. 5, and with reference to FIG. 1 and the description thereof, when the carriage angle is 30°, the incremental increase in resistance from starting point S is equal to the sine of 30° divided by the sine of 28°, or 1.066 times the starting resistance. Likewise, when the carriage angle is 33° the resistance is 1.058 times the resistance at a carriage angle of 30°, and so on as shown in the chart, until the carriage angle reaches its final angle of approximately 44°.

It will thus be seen that the resistance varies automatically and instantaneously as the carriage angle varies to provide a variable resistance in accordance with the strength curve of the particular muscle group being exercised.

In illustrating the method of the invention reference is again made to FIG. 3. The exerciser lies with his back flat on pad 28 of carriage 18 and braces his feet on foot rest 6 against stop 33 thereon. As heretofore noted, at the start of the exercise the exerciser's knees are drawn close to his chest. The exerciser positions his head between padded shoulder restraints 34 and 34A and positions his arms on padded arm rests 30 and 30A.

The exerciser, grasping padded arm rests 30 and 30A, pushes against foot rest 6 and by so doing displaces carriage 18 and its associated weight 38 upward along discretely curved rails 14 and 14A until the carriage reaches finishing point F (FIG. 4), at which times the exerciser's legs are substantially extended. The exerciser may then allow carriage 18 to slide down rails 14 and 14A to starting point S (FIG. 4), and at which time the deep-knee-bend exercise as heretofore described may be repeated. Weight 38 carried on underside 39 of carriage 18 may be increased or decreased to accommodate the desired intensity of the exercise and the increased strength of the exerciser as will now be understood by those skilled in the art.

There has thus been described variable-resistance exercising apparatus and method whereby the resistance encountered by the exerciser varies closely with the strength curve of the muscle or muscle group being exercised. The exercise is performed by displacing a weight up a discretely curved incline, whereby the resistance varies automatically and instantaneously commensurate with the sine of the varying angle of incline. The exercising apparatus and method described have the advantage of reducing the chances of injury, especially at the beginning of the exercise, which is generally when the exerciser has the least strength due to minimum leverage, and provides a variable level of exercise intensity as may be desired.

Although but a single embodiment of the invention has been illustrated and described in detail, it is to be expressly understood, that the invention is not limited thereto. Various changes may also be made in the design and arrangement of the parts of the apparatus and the steps of the method described without departing from the spirit and scope of the invention as the same will now be understood by those skilled in the art. For example, although the invention has been desribed with reference to apparatus and method for performing the deep-knee-bend exercise, apparatus and method for performing other exercises are within the scope of the invention as well.

What is claimed is:

1. Exercising apparatus providing a discrete variable resistance commensurate with the strength curve of the body muscles being exercised, and commensurate with the strength of an exerciser and the desired intensity of the exercise being performed, comprising a frame including an inclined plane which is discretely curved so that the angle of incline varies instantaneously and automatically;

a carriage displaceably carried by the frame and supporting the body of the exerciser;

the carriage carrying a weight commensurate with the strength of the exerciser and the desired intensity of the exercise being performed;

means supported by the frame and the exerciser exerting a force in one sense against said means to displace the carriage in he opposite sense up the inclined plane; and the exerciser encountering a discrete variable resistance when displacing the carriage up the inclined plane, said resistance varying instantaneously and automatically with the sines of the varying angles of incline and with the strength curve of the body muscles being exercised, and with the strength of the exerciser and the desired intensity of the exercise being performed.

2. Apparatus as described by claim 1, wherein the frame including a discretely curved inclined plane having a varying angle of incline includes:

a pair of side frame members disposed in parallel and spaced relation with each other;

means for rigidly securing said frame members in said parallel and spaced relation;

each of the side frame members carrying corresponding discretely curved inclined members; and the corresponding discretely curved inclined members forming the inclined plane.

3. Apparatus as described by claim 2, wherein:

the carriage is displaceably carried by the corresponding discretely curved inclined members.

4. A method whereby an exerciser performs an exercise having a discrete variable resistance commensurate with the strength curve of the body muscles being exercised and commensurate with the strength of the exerciser and the desired intensity of the exercise, comprising:

providing an inclined plane which is discretely curved so that the angle of incline varies instantaneously and automatically;

displaceably supporting a carriage on the inclined plane;

positioning the body of the exerciser on the carriage and the exerciser exerting a force for displacing the carriage up the inclined plane;

the exerciser encountering a discrete variable resistance to the carriage displacement, said resistance varying instantaneously and automatically commensurate with the sines of the varying angles of incline and also varying commensurate with the strength curve of the body muscles being exercised, and with the strength of the exerciser and the desired intensity of the exercise; and the exerciser varying the force exerted for overcoming the varying resistance.

* * * * *